US005778974A

United States Patent [19]

Kazikawa et al.

[11] Patent Number: 5,778,974

[45] Date of Patent: Jul. 14, 1998

[54] LAMINATED TYPE HEAT EXCHANGER HAVING SMALL FLOW RESISTANCE

[75] Inventors: Yoshiharu Kazikawa, Hekinan; Toshio Ohara; Eiichi Torigoe, both of Kariya; Yasukazu Aikawa, Nagoya, all of Japan

[73] Assignee: Nippondenso Co., Ltd., Kariya, Japan

[21] Appl. No.: 697,617

[22] Filed: Aug. 28, 1996

[30] Foreign Application Priority Data

Aug. 29, 1995 [JP] Japan ..... 7-220902

[51] Int. Cl.[6] ..... F28D 1/03

[52] U.S. Cl. ..... 165/153; 165/176; 165/DIG. 466

[58] Field of Search ..... 165/152, 153, 165/176, DIG. 464–467

[56] References Cited

U.S. PATENT DOCUMENTS

| | | | |
|---|---|---|---|
| 4,974,670 | 12/1990 | Noguchi | 165/153 |
| 5,024,269 | 6/1991 | Noguchi et al. | 165/153 |
| 5,137,082 | 8/1992 | Shimoya et al. | 165/110 |
| 5,503,223 | 4/1996 | Choi et al. | 165/153 |

FOREIGN PATENT DOCUMENTS

| | | | |
|---|---|---|---|
| 68831 | 3/1941 | Czechoslovakia | 165/178 |
| 3-191296 | 8/1991 | Japan | 165/153 |
| 6194001 | 7/1994 | Japan . | |

*Primary Examiner*—Allen J. Flanigan
*Attorney, Agent, or Firm*—Harness, Dickey & Pierce

[57] ABSTRACT

A laminated type heat exchanger includes a plurality of tube elements laminated so as to form a first tank portion, a second tank portion, and a third tank portion in a laminated direction. Each tube element includes a first flange, a second flange, and a third flange for the first tank portion, the second tank portion, and the third tank portion, which are brazed with a first flange, a second flange, and a third flange of an adjacent tube element, respectively. The first flange is folded inside the first tank portion, the second flange is folded outside the second tank portion, and the third flange is folded outside the third tank portion. In this way, it is possible to reduce the flow resistance of the refrigerant flowing in the tank portions.

10 Claims, 14 Drawing Sheets

LAMINATED TYPE HEAT EXCHANGER HAVING SMALL FLOW RESISTANCE

CROSS REFERENCE TO RELATED APPLICATION

The present invention is based upon and claims priority of Japanese patent Application No. Hei 7-220902 filed on Aug. 29, 1995.

BACKGROUND OF THE INVENTION

1. Field of the Invention

The present invention relates to a laminated type heat exchanger which is especially suitable for a laminated type refrigerant evaporator.

2. Description of Related Art

A conventional laminated type heat exchanger as disclosed in JP-A-6-194001 includes a heat exchanging portion structured by laminating alternate tube elements which are manufactured by bonding a pair of plates together, fins for promoting the heat radiating effect, and three tank portions fixed to the heat exchanging portion.

According to the heat exchanger having three tank portions, the outlet port of a refrigerant inlet-outlet pipe can be disposed at the same side surface of the heat exchanger thus simplifying the installation of the refrigerant pipe.

However, the heat exchanger having three tank portions as described above has each tank portion with a smaller diameter than each tank portion associated with a heat exchanger having two tank portions. As a result, the area of the refrigerant passage in each tank portion is reduced and flow resistance of refrigerant in each tank portion increases. Thus, the pressure loss of the refrigerant in the heat exchanging portion increases i.e., cooling capacity of the evaporator declines when a heat exchanger with smaller tank portions is employed as an evaporator.

Furthermore, in the above conventional type, as shown in FIG. 12, a plurality of flanges 210 are folded inside each tank portion formed by a plurality of tube elements 110. Flanges 210 serve as faces for brazing adjacent tube elements 110 to form tank portions 201–203. Therefore, the flow resistance of the refrigerant in each of tanks 201–203 further increases due to flanges 210 being folded inside.

The inventors have experimented with the relationship between a flowing volume of refrigerant and the flow resistance of the refrigerant into a heat exchanger having three tank portions 201–203 with flanges 210 folded inside each of the tank portions 201–203 as shown in FIG. 12 and with a heat exchanger having two tank portions 301 and 302 with a plurality of flanges 310 folded inside each of tank portions 301 and 302 as shown in FIG. 13.

As a result, in FIG. 14, the dotted line shows the heat exchanger having three tank portions 201–203 in FIG. 12 whereas the broken line shows the heat exchanger having two tank portions 301 and 302 in FIG. 13. The diameter D of tank portion 202 in FIG. 12 is 15 mm while the diameter D of tank portion 301 in FIG. 13 is 25 mm.

Since diameter D of tank portion 202 in FIG. 12 is smaller than that of tank portion 301 in FIG. 13, the flow resistance of refrigerant in tank portions 201–203 in FIG. 12 is significantly increased over that of the refrigerant in tank portions 301–302 in FIG. 13.

SUMMARY OF THE INVENTION

In light of the above-described problem, the present invention has an object of providing a laminated type heat exchanger having three tank portions with an extremely low flow resistance of refrigerant flowing through the tank portions.

According to the present invention, a laminated type heat exchanger includes a plurality of tube elements, each tube element forming a tube in which refrigerant is in a heat exchanging relationship with air. The plurality of tube elements being laminated one by one so as to from a first tank portion, a second tank portion, and a third tank portion in the laminated direction. Adjacent tube elements are brazed with each other, and refrigerant flows through the second tank portion, then through the tube, and then through the third tank portion. Each tube element includes a first flange, a second flange, and a third flange for the first tank portion, the second tank portion, and the third tank portion, which are brazed with a first flange, a second flange, and a third flange of an adjacent tube element, respectively. The first flange is folded inside the first tank portion, the second flange is folded outside the second tank portion, and the third flange is folded outside the third tank portion.

In this way, there are no flanges which are folded inside the second and the third tank portions. Therefore, it is possible to increase the refrigerant flow area in the tank portions due to the removal of the flanges as compared with the conventional type of heat exchanger shown in FIG. 12, so that flow resistance of refrigerant flowing in the tank portions is reduced.

Thus, the flow resistance of refrigerant in the second and the third tank portions communicating with the tubes, which contributes to the heat exchange with an outside medium is reduced when compared to the conventional type shown in FIG. 12.

Positioning flanges for positioning the respective tube elements may be formed at the end of the first flanges.

The above positioning flanges are more easily formed when the positioning flanges are folded inside the tank portions than when the positioning flanges are folded outside the tank portions due to the number of press operations. Therefore, the positioning flanges can be easily formed on the first flanges. Additionally, it is easy to position the respective tube elements by using the positioning flanges.

Refrigerant may flow into the first tank portion from the outside and further flows directly into the second tank portion without passing through the tubes. In this way, although the flow resistance of refrigerant in the first tank portion becomes large due to the first flanges being folded inside the first tank portion, the refrigerant in the first tank portion flows directly to the second tank portion without passing through the tubes which contributes to the heat exchanging capacity, i.e., since the refrigerant in the first tank portion does not contribute to heat exchange, heat exchanging performance by the heat exchanger does not have an adverse influence even if the flow resistance of refrigerant in the first tank portion increases.

The above laminated type heat exchanger may be employed as the refrigerant evaporator of a refrigerating cycle. Cooling capacity of the evaporator can be improved since the flow resistance of refrigerant in the tank portions can be reduced from that of the conventional type shown in FIG. 12.

Other objects and features of the invention will be appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompany drawings in which.

DETAILED DESCRIPTION OF THE PRESENTLY PREFERRED EMBODIMENTS

A first embodiment in which the present invention is applied to a laminated type refrigerant evaporator as an air conditioner for a vehicle will be described with reference to FIGS. 1–7.

Figure 1:
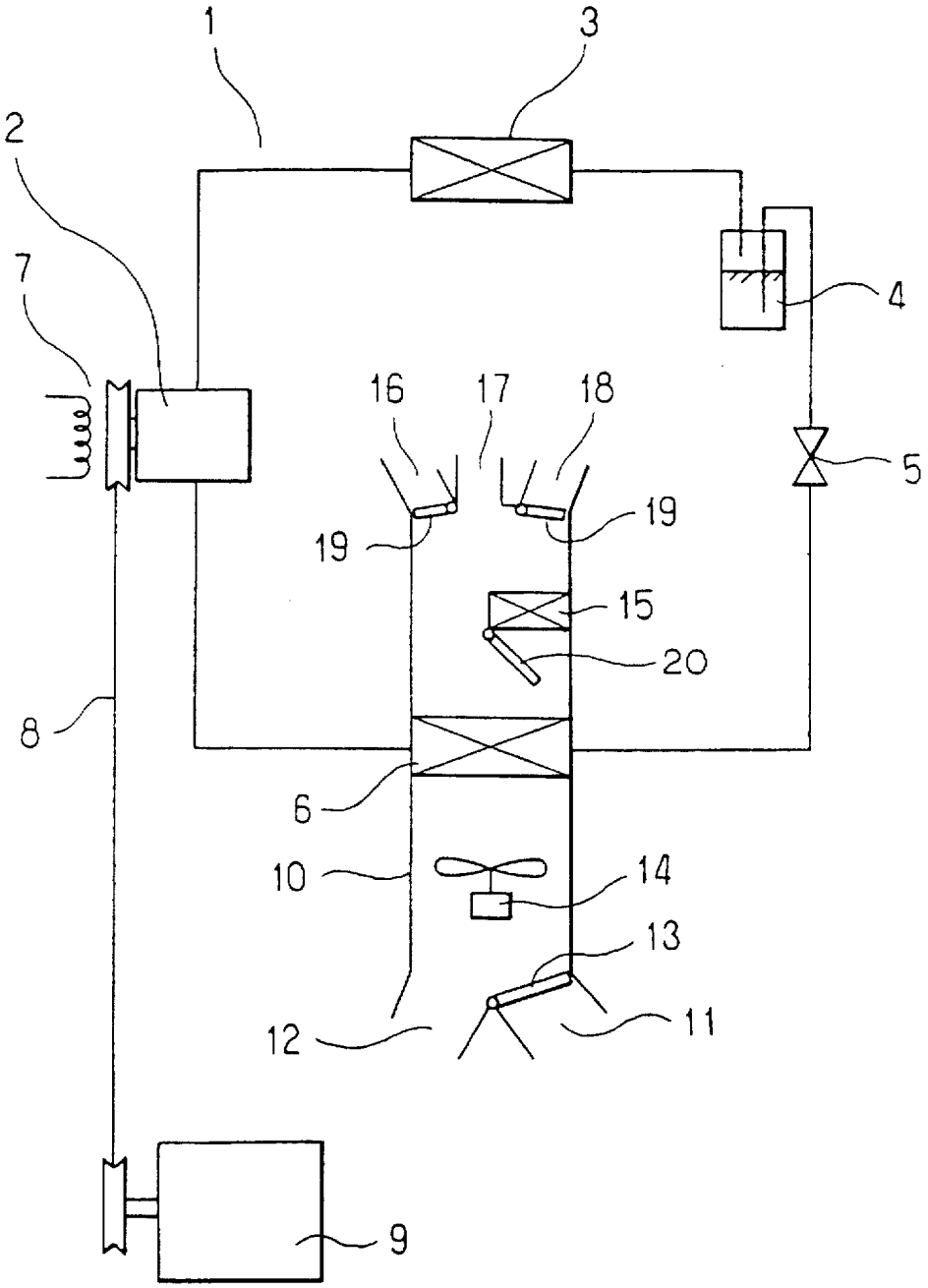
FIG. 1 is a schematic view showing a refrigerating cycle and an air ventilating system according to a first embodiment of the present invention.

Firstly, a refrigerating cycle and an air ventilating system of the embodiment will be described as shown in FIG. 1.

In FIG. 1, a refrigerating cycle 1 includes a compressor 2 for compressing refrigerant, a condenser 3 for condensing the refrigerant from the compressor 2 by exchanging heat with outside air, a receiver 4 for accumulating surplus refrigerant temporarily in accordance with a load of refrigerating cycle 1, an expansion valve 5 (a pressure reducing means) for expanding and reducing the pressure of the refrigerant received from receiver 4, and a refrigerant evaporator 6 for evaporating the two-phase refrigerant of gas and liquid received from expansion valve 5 by exchanging heat with the air inside an air conditioning duct 10.

Compressor 2 is connected to a vehicle engine 9 via an electromagnetic clutch 7 and a belt 8. When electric power is supplied to electromagnetic clutch 7, rotating driving force of vehicle engine 9 is transmitted, whereas when electric power is not supplied to electromagnetic clutch 7, rotating driving force of vehicle engine 9 is not transmitted.

Evaporator 6 is disposed in air conditioning duct 10 (an air passage) communicating with a passenger compartment of the vehicle. An inside air inlet 11 for admitting the air from the passenger compartment and an outside air inlet 12 for admitting the outside air are formed at the air upstream side of air conditioning duct 10. Air inlets 11 and 12 are selectively opened or closed by an inside/outside air switching means 13. Blower means 14 for blowing air toward the passenger compartment by drawing inside air from inlet 11 or outside air from inlet 12 is disposed at a downstream position in air conditioning duct 10. Heating means 15 for heating air by using cooling water of engine 9 as a heating source is disposed at an air downstream side of evaporator 6 in air conditioning duct 10. A defroster air outlet 16 for blowing the air against the inside of the windshield of the vehicle, a face air outlet 17 for blowing the air to the upper half of the body of a passenger in the vehicle, and a foot air outlet 18 blowing the air toward the lower half of the body of the passenger in the vehicle are formed at the downstream end of air conditioning duct 10. These outlets are selectively opened or closed by an outlet switching means 19.

When compressor 2 is driven by supplying electric power to electromagnetic clutch 7, two-phases refrigerant (gas and liquid) flowing in evaporator 6 evaporates by absorbing heat from air in air conditioning duct 10, and thereby air inside air conditioning duct 10 is cooled. After the temperature of the cool air passing through evaporator 6 is adjusted by an air mixing damper (a temperature adjusting means) 20, the cool air is blown into the passenger compartment from either one of the aforementioned air outlets 16–18.

Figure 2:
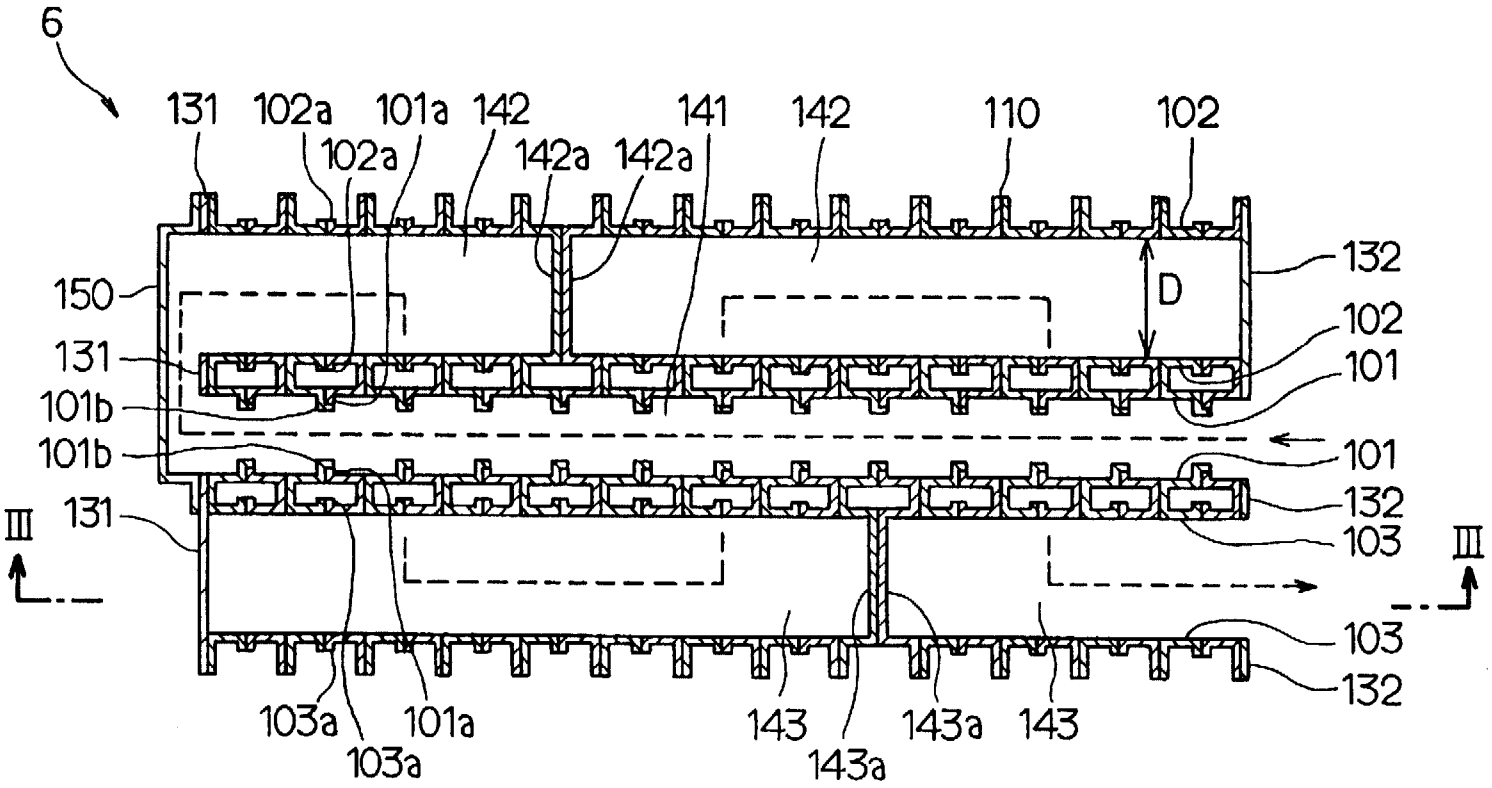
FIG. 2 is a cross-sectional view of an evaporator according to the first embodiment.
Figure 3:
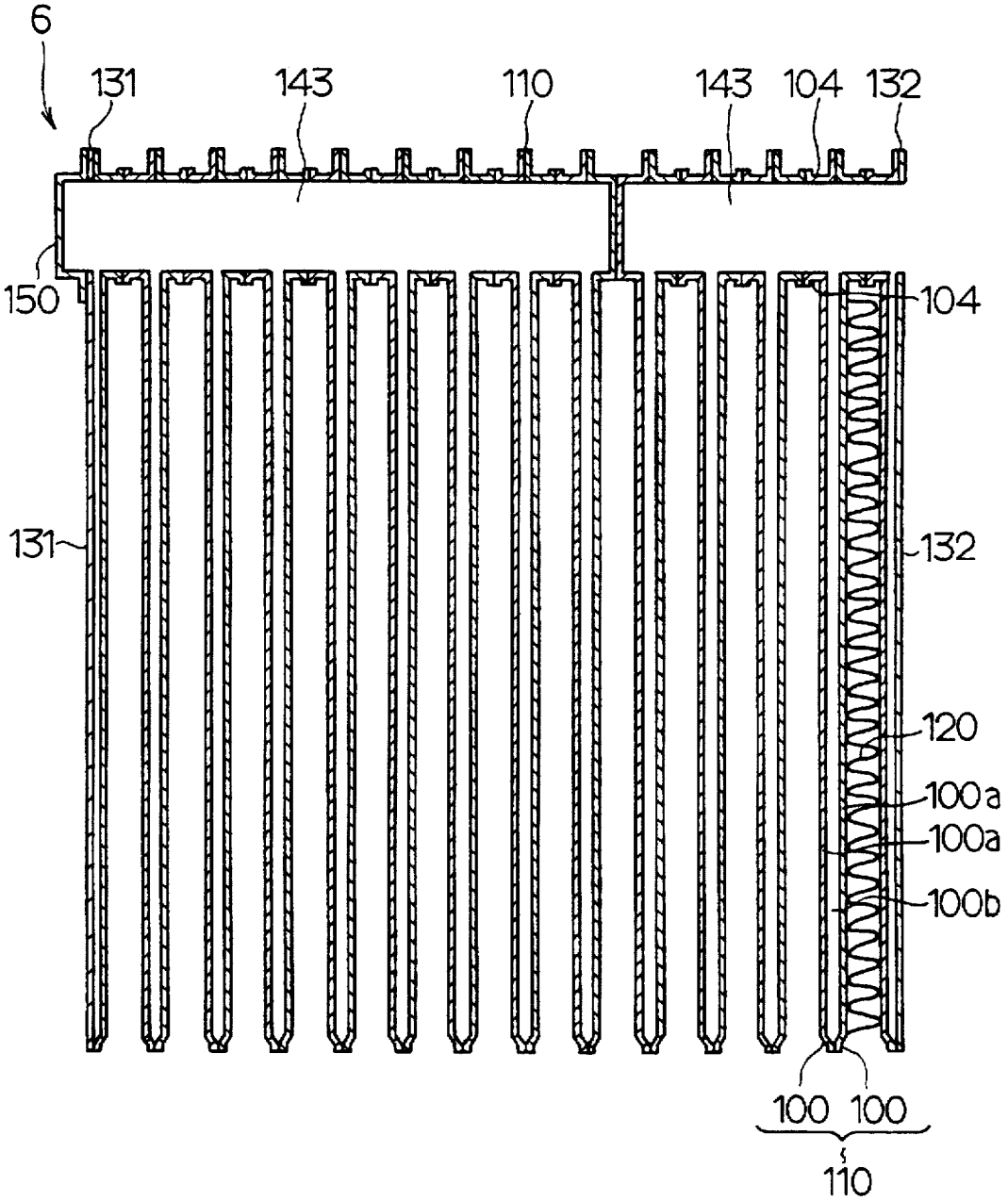
FIG. 3 is a view taken along the line III—III of FIG. 2.

The structure of evaporator 6 will be described based on FIGS. 2 and 3. FIG. 2 is a cross-sectional view of the tank portions of evaporator 6, whereas FIG. 3 is a cross-sectional view taken along the line A—A of FIG. 2.

The heating exchanging portion of evaporator 6 is composed of a plurality of tube elements 110 each manufactured by bonding together a pair of pressed plates 100 made of aluminum, and a wavy corrugated fin 120 for promoting the heat radiating effect. Fin 120 is made of aluminum, i.e., the same material as tube element 110. The plurality of tube elements 110 and corrugated fins 120 are assembled alternately in the horizontal direction, as shown in FIG. 3. A pair of end plates 131 and 132 made of aluminum are disposed at the ends of the heating exchanging portion of evaporator 6.

Plates 100 have concave portions 100*a* forming a U-shaped passage. Cylindrical first, second, and third protruding portions 101–103 protrude in the perpendicular direction with respect to the surface of plates 100 and are formed parallel to each other at one end (upper part of FIG. 3) of concave portions 100*a* forming the U-shaped passage.

Figure 4:
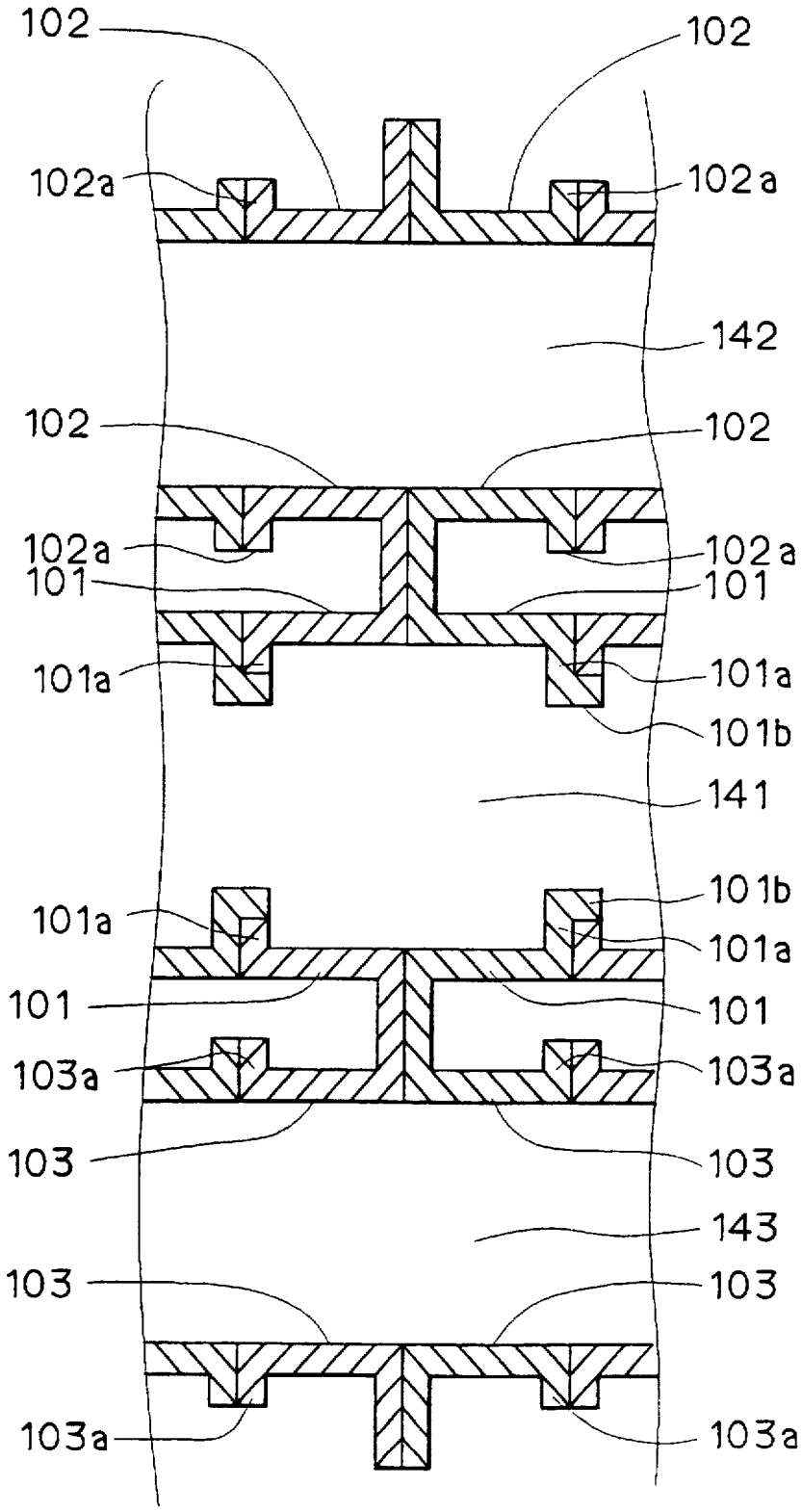
FIG. 4 is a partial enlarged view of FIG. 2.

The shapes of the top ends of the first to the third protruding portions 101–103 will be described with reference to FIG. 4 which is a partial enlarged view of FIG. 2.

First flange 101*a* is folded inside a first tank portion 141 and is formed on the entire periphery of the top ends of first protruding portions 101 of one part of plates 100.

First flanges 101*a* are formed on the entire periphery of the end portions of first protruding portions 101 of the other part of the plates 100. In addition, flanges 101*b* protrude in the same direction as first protruding portions 101 and are formed on the entire periphery of the top ends of first flanges 101*a*.

Second flanges 102*a* are folded outside a second tank portion 142 and are formed on the entire periphery of the top ends of second protruding portions 102. Third flanges 103*a* are folded outside a third tank portion 143 and are formed on the entire periphery of the top ends of third protruding portions 103.

In evaporator 6 shown in FIGS. 2 and 3, first protruding portions 101, second protruding portions 102 and third protruding portions 103 of each pair of adjacent tube elements 110 are connected to each other. Flanges 101*b* of first protruding portions 101 are engaged with the first flanges 101*a* of the opposed tube element 110, thereby positioning each of the tube elements 110.

As a result, first protruding portions 101, second protruding portions 102, and third protruding portions 103, which are laminated, form first tank portion 141, second tank portion 142, and third tank portion 143 in a substantial cylindrical shape extending in the laminated direction, respectively. A space made by facing concave portions 100*a* for forming each U-shaped passage to each other forms tubes 100*b*. The diameters (the widths shown by D in FIG. 2) of second and third tank portions 142 and 143 are 15 mm.

In end plates 132, openings are formed at the positions corresponding to first tank portion 141 and second tank portion 142, respectively. In addition, a U-turn plate 150 forms a U-turn passage for connecting the tank portions with each other. In end plates 132, openings are formed at the positions corresponding to first tank portion 141 and third tank portion 143, respectively.

A method for forming first, second and third protruding portions 101–103 and the top ends of those will be described.

Figure 5A:
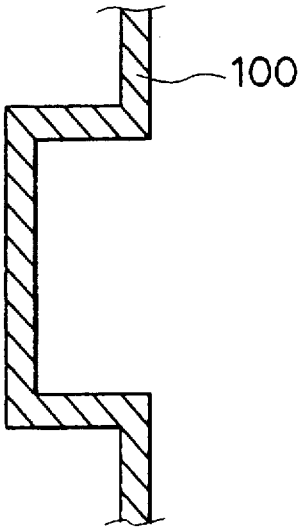
FIGS. 5A–5D are views of a forming process of first flanges 101*b* according to the first embodiment.
Figure 5B:
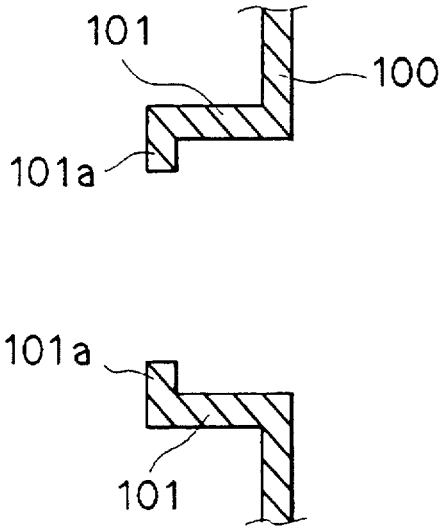
Figure 5C:
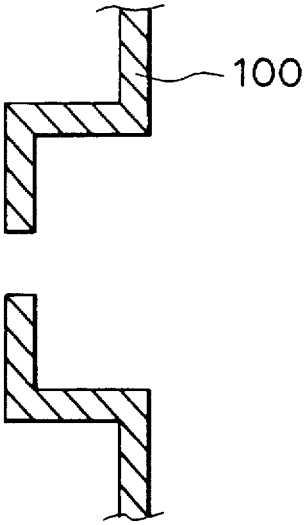

First protruding portions 101 of one pair of plates 100 are deeply drawn. By repeating this process, a bottom is manufactured at the portion as shown in FIG. 5A. First flanges 101*a* shown in FIG. 5B are formed by punching a hole which has a diameter slightly smaller than that of the bottom.

Figure 5D:
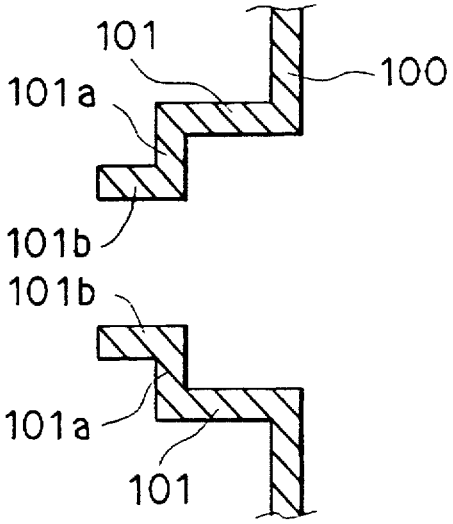

On the other hand, first protruding portions 101 on the other pair of plates 100 are also deeply drawn, as shown in FIG. 5A, in the same method as described above. First flanges 101*a* and flanges 101*b* are formed by punching a hole (FIG. 5C) which has a diameter smaller than that of the hole in FIG. 5B, and then forming flanges 101*b* as shown in FIG. 5D.

Figure 6A:
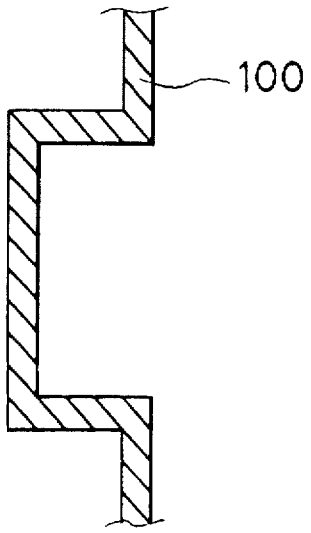
FIGS. 6A–6D are views of a forming process of the second flanges and the third flanges according to the first embodiment.
Figure 6B:
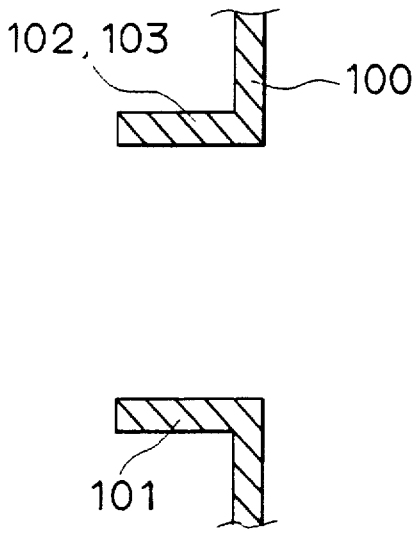
Figure 6C:
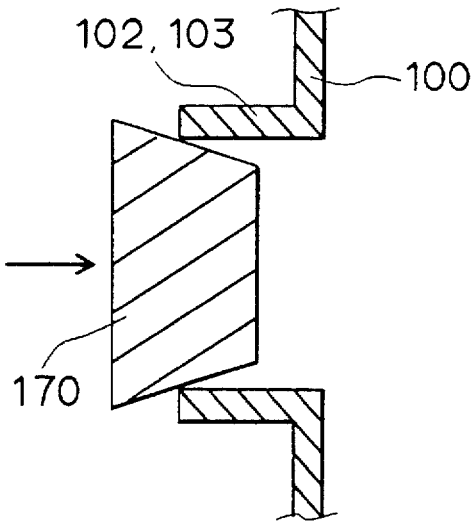
Figure 6D:
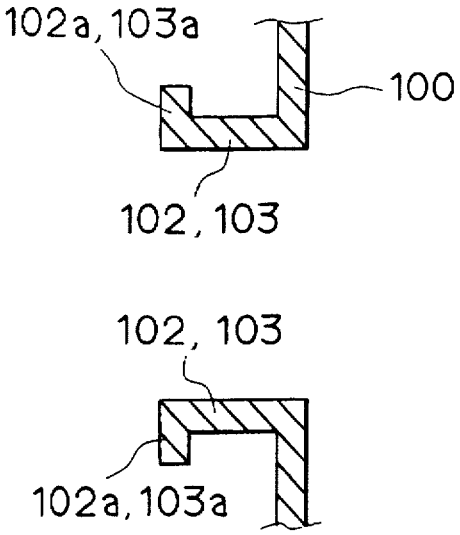

As for second protruding portions 102 and third protruding portions 103, a bottom is manufactured at a part of plate 100 as shown in FIG. 6A in the same manner as first protruding portions 101. Then, second protruding portions 102 and third protruding portions 103 are formed by punching this bottom portion as shown in FIG. 6*b*. Second flanges 102*a* and third flanges 103*a* are formed on the respective protruding portions 102 and 103 as shown in FIG. 6D by pressing the top ends of the protruding portions 102 and 103 in the direction of the arrow in FIG. 6C with a tapered member 170.

The flow of the refrigerant in the evaporator will now be described.

Firstly, when refrigerant from expansion valve 5 (FIG. 1) flows into first tank portion 141 as shown with a dotted line in FIG. 2, it flows through first tank portion 141 and goes into second tank portion 142 through the U-turn passage formed by U-turn plate 150.

Since partition members 142*a* and 143*a* are disposed in second tank portion 142 and third tank portion 143, respectively, refrigerant meanders through second tank portion 142, tubes 101*b*, third tank portion 143, tubes 100*b*, second tank portion 142, tubes 100*b* to third tank portion 143. Finally, refrigerant is drawn into compressor 2 (FIG. 1) after flowing out of the outlet of third tank portion 143.

Adjacent tube elements 110 form tank portions 141–143.

Figure 12:
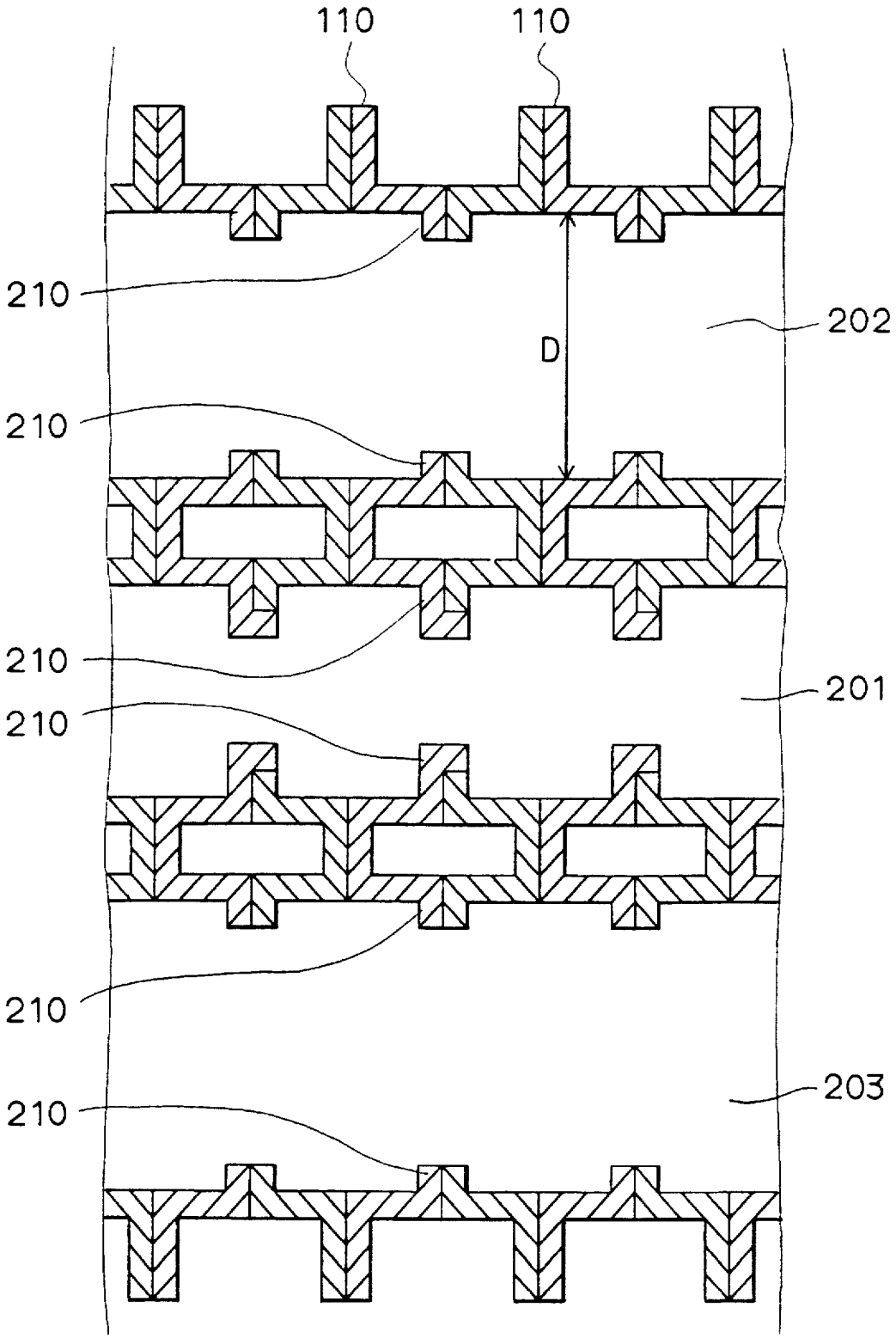
FIG. 12 PRIOR ART
FIG. 12 is a cross-sectional view showing a part of tank portions of a prior art laminated type heat exchanger.

According to the above embodiment, flanges 101*a* for the first tank portions, i.e., faces which are brazed with the adjacent tube elements 110 are formed by folding flanges 101*a* inside tank portion 141 in the same manner as in the prior art type as shown in FIG. 12. However, flanges 102*a* and 103*a* are folded outside the tank portion of second and third tank portions 142 and 143. In this way, the flow area of refrigerant in second and third tank portions 142 and 143 are larger than that of tank portions 202 and 203 in FIG. 12. Accordingly, it is possible to reduce the flow resistance of refrigerant in second and third tank portions 142 and 143.

Figure 7:
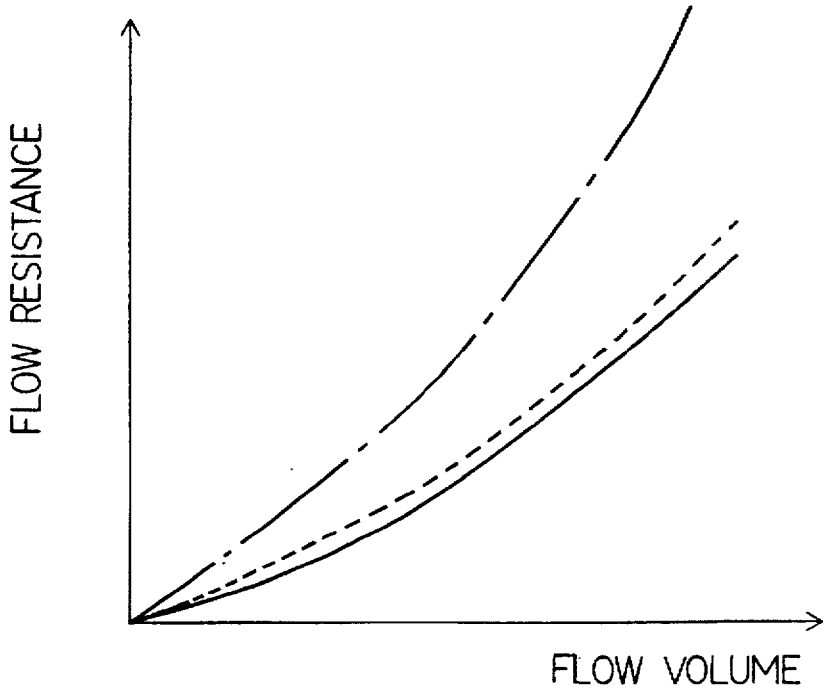
FIG. 7 is a graph of experimental data showing the relationship between a flow volume of refrigerant and flow resistance of the refrigerant in the first embodiment of the present invention and the prior art shown in FIGS. 12 and 13.

When the flow resistance of the refrigerant was measured in tank portions 142 and 143 using evaporator 6 in this embodiment, data was obtained as shown by the solid line of FIG. 7. The dotted line and the broken line in FIG. 7 correspond to those shown in FIG. 14 where the dotted line indicates the evaporator having three tank portions as shown in FIG. 12 whereas the broken line indicates the evaporator having two tank portions as shown in FIG. 13.

Figure 13:
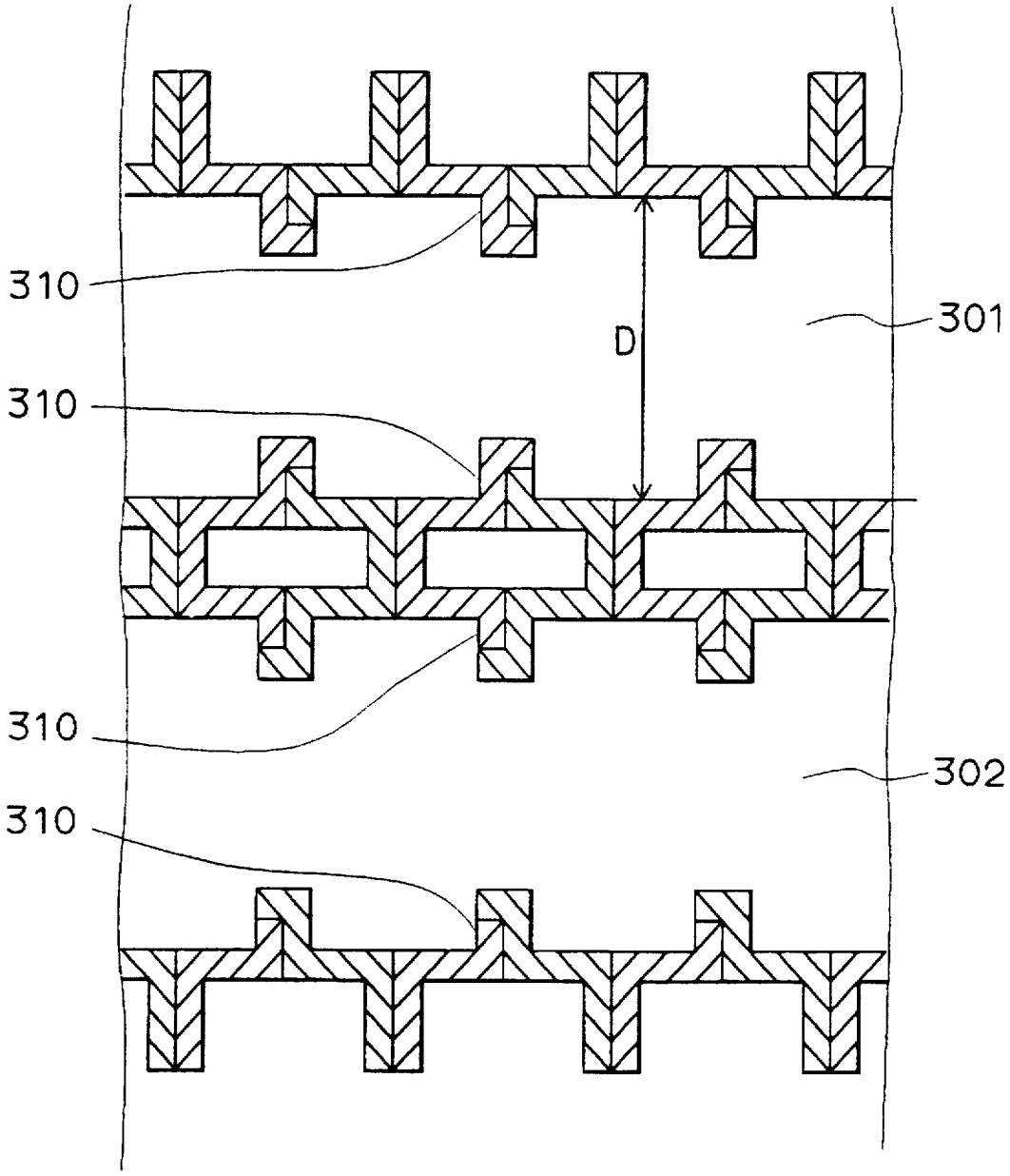
FIG. 13 PRIOR ART
FIG. 13 is another cross-sectional view showing a part of tank portions of a prior art laminated type heat exchanger.
Figure 14:
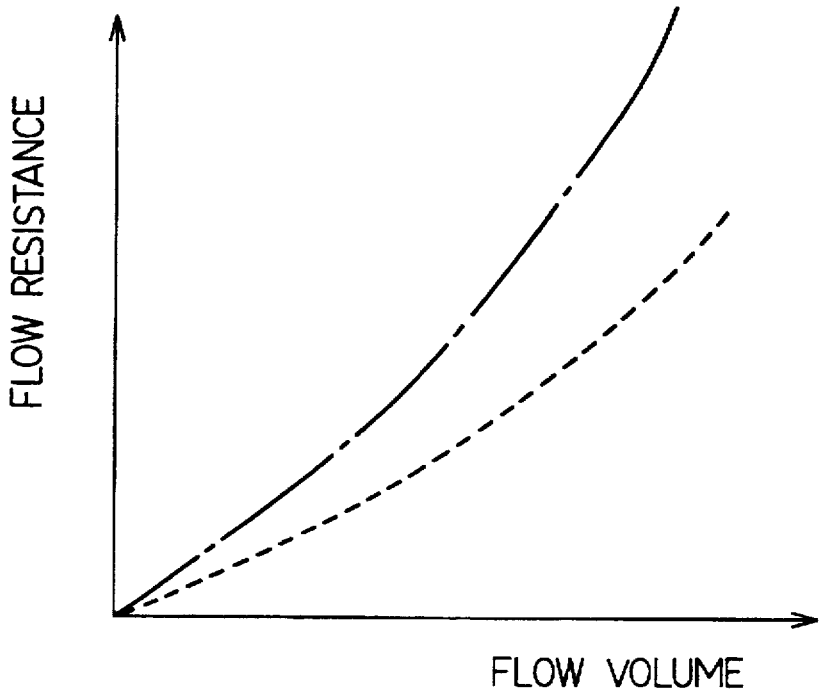
FIG. 14 PRIOR ART
FIG. 14 is a graph of experimental data showing the relationship between a flow volume of refrigerant and flow resistance of the refrigerant in the heat exchangers shown in FIGS. 12 and 13.

As can be clearly understood from the data in FIG. 7, in the present invention, although there are three tank portions, the flow resistance of refrigerant inside tank portions 142 and 143 can be substantially the same as the flow resistance of refrigerant shown in FIG. 13. This is because flanges 210 are folded inside in FIG. 12 and flanges 102*a* and 103*a* are not formed inside second and third tank portions 142 and 143.

During the manufacture of evaporator 6, when a plurality of elements 110 are laminated, it is necessary to provide flanges 101*b* (FIG. 4) in either one of the tank portions in order to position the respective tube elements 110. However, it is difficult to form flanges 101*b* at flanges 102*a* and 103*a* because they are folded outside the tank portions which increases the number press operations.

Accordingly, in order to form flanges 101*b*, it is necessary to form flanges folded inside at least one of the tank portions among the three tank portions 141–143. That is, at least one of the three tank portions 141–143 has the problem in which pressure loss of refrigerant due to the flanges being folded inside is unavoidable.

According to the present embodiment, a tank portion having flanges folded inside is provided on first tank portion 141 which does not have a refrigerant passage to tubes 100*b*. Because first tank portion 141 has no relation to the heat exchange in the heat exchanging portion, even if some pressure loss of refrigerant is caused in first tank portion 141, there is no pressure loss of refrigerant due to the flanges in the heat exchanging portion.

Modifications of the embodiment will be described with reference to FIGS. 8–11. FIGS. 8–11 are views corresponding to FIG. 2 to show each modification. The shape of the top ends of the first to the third protruding portions 101–103 in each modification is the same as the above embodiment.

Figure 8:
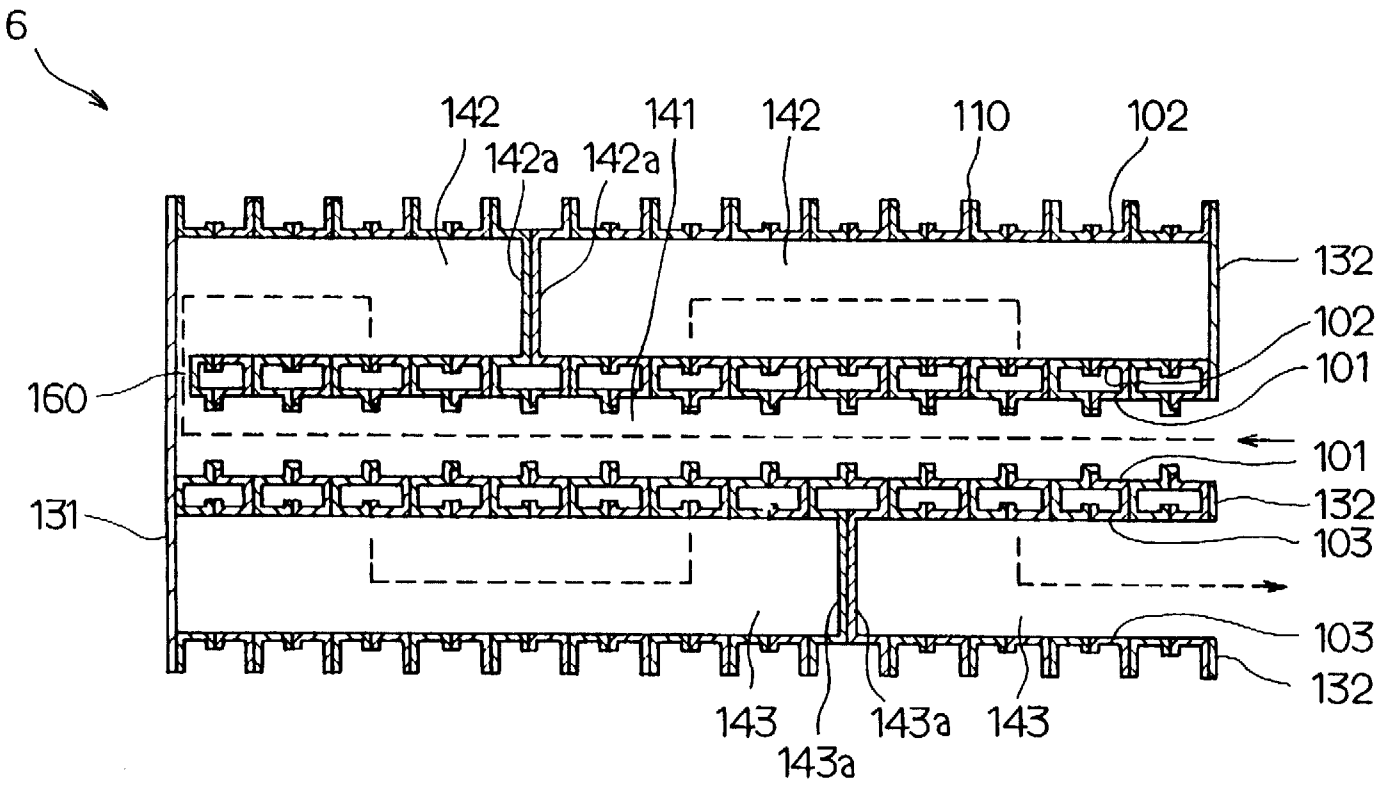
FIG. 8 is a view corresponding to FIG. 2 to show a modification of the first embodiment.

As shown in the modification shown in FIG. 8, the openings of U-turn plate 150 and end plate 131 disposed in the first embodiment may be removed. In such a case, a communicating passage 160 for communicating first protruding portions 101 with second protruding portions 102 of plate 100 is formed. Communicating passage 160 turns back refrigerant from first tank portion 141 to second tank portion 142.

Figure 9:
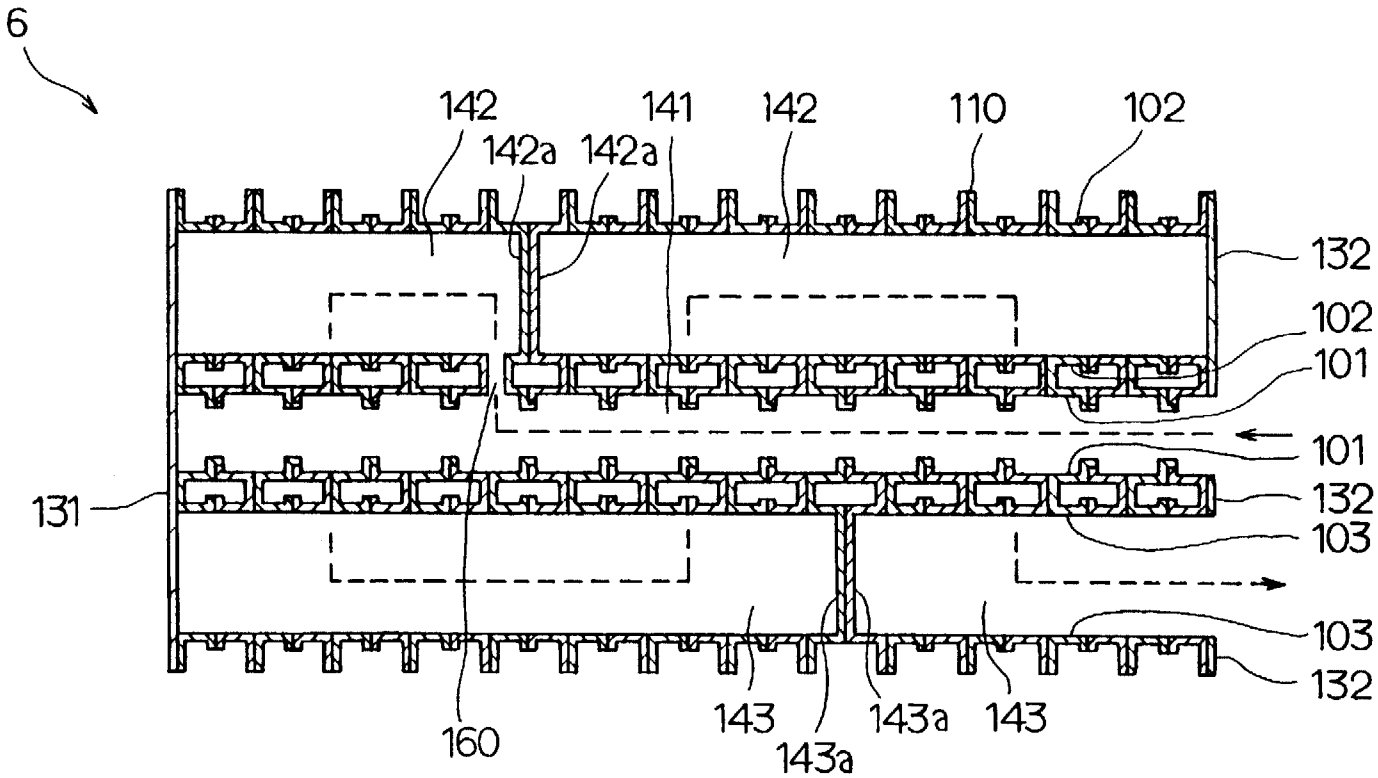
FIG. 9 is a view corresponding to FIG. 2 to show another modification of the first embodiment.

As shown in the modification shown in FIG. 9, communicating passage 160 may be disposed at the side of partition members 142*a*.

Figure 10:
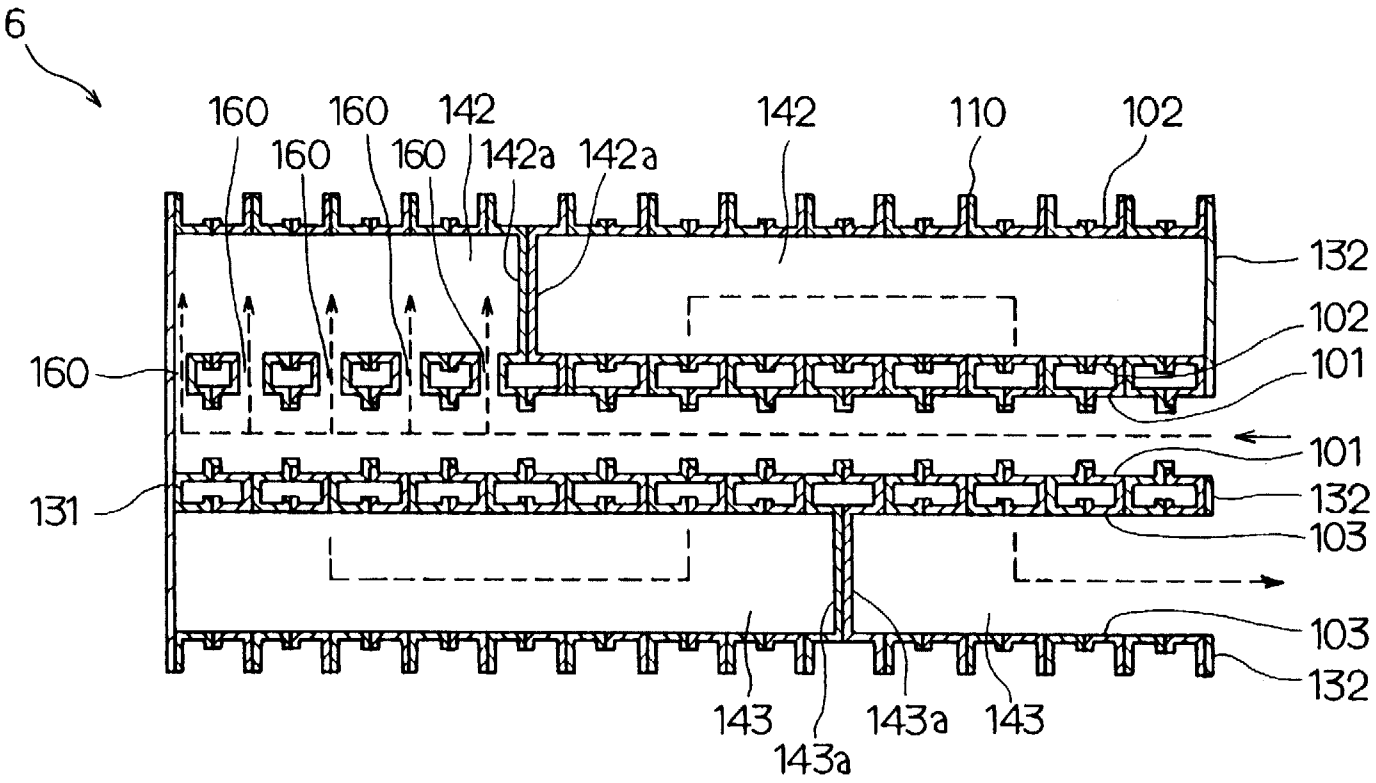
FIG. 10 is a view corresponding to FIG. 2 to show another modification of the first embodiment.

As shown in the modification shown in FIG. 10, a plurality of communicating passages 160 may be disposed between first tank portion 141 and second tank portion 142.

Figure 11:
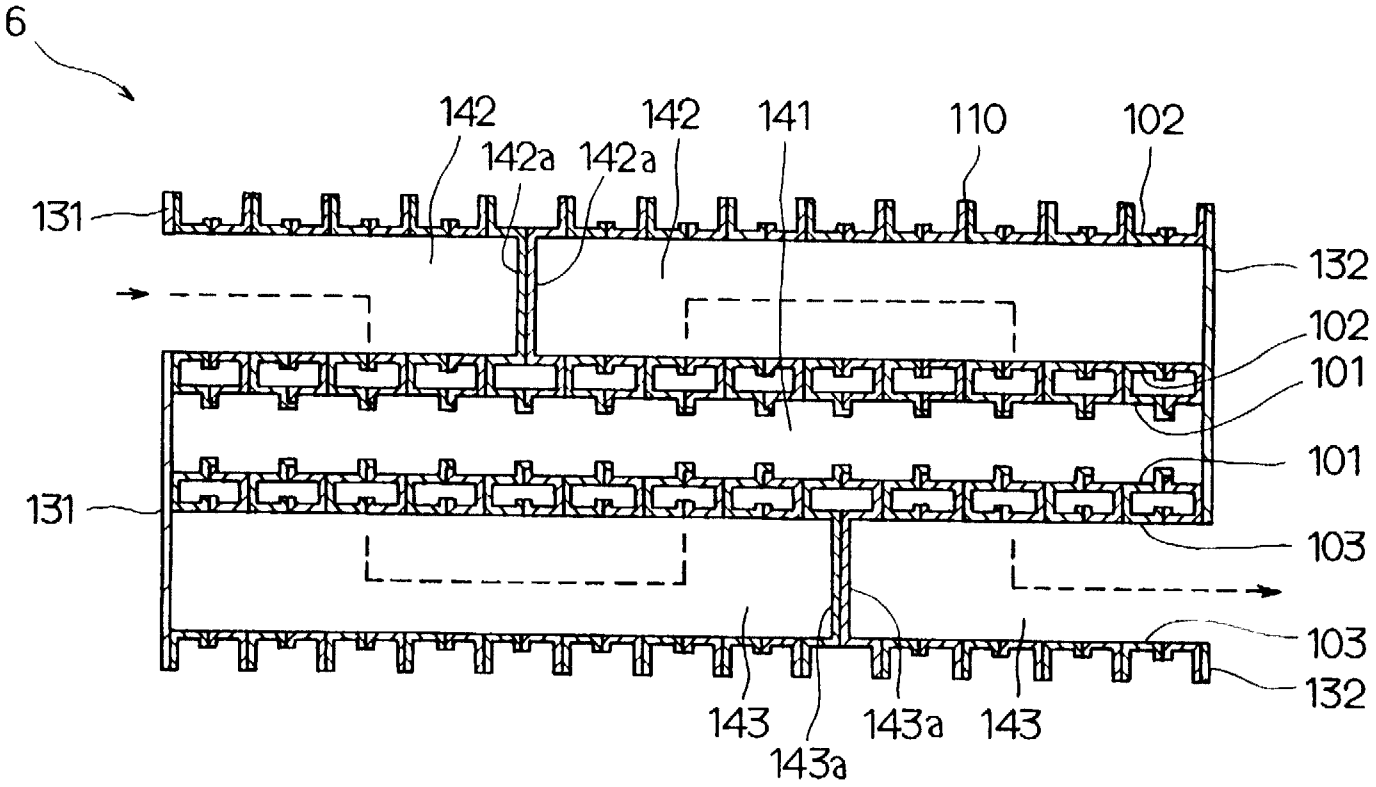
FIG. 11 is a view corresponding to FIG. 2 to show another modification of the first embodiment.

As shown in the modification shown in FIG. 11, both ends in the laminated direction of first tank portion 141 may be closed by end plates 131 and 132 in such a manner that refrigerant does not flow into first tank portion 141 but flows only into second tank portion 142 and third tank portion 143.

Although the present invention has been fully described in connection with the preferred embodiments thereof with reference to the accompanying drawings, it is to be noted that various changes and modifications will become apparent to these skilled in the art. Such changes and modifications are to be understood as being included within the scope of the present invention as defined by the appended claims.

What is claimed is:

1. A laminated heat exchanger comprising:

a plurality of tube elements, each tube element forming a tube in which refrigerant flows, said plurality of tube elements being secured together so as to form a first tank portion, a second tank portion, and a third tank portion, said refrigerant flowing through said second tank portion, through said tube, and through said third tank portion, wherein said tube element includes a first flange folded inside said first tank portion, a second flange folded outside said second tank portion, and a third flange folded outside said third tank portion, said first, second and third flanges of said tube element being secured to a first, second and third flange of an adjacent tube element.

2. A laminated heat exchanger according to claim 1, wherein said first flange includes a positioning flange portion for positioning said adjacent tube element.

3. A laminated heat exchanger according to claim 1, wherein refrigerant flows into said first tank portion and further flows directly into said second tank portion without passing through said tube.

4. A laminated heat exchanger according to claim 3, further comprising:

an end plate disposed at an end of said tube element for directing flow of said refrigerant from said first tank portion to said second tank portion.

5. A laminated heat exchanger according to claim 3, wherein said tube element is formed by brazing a pair of pressed plates.

6. A laminated heat exchanger according to claim 5, wherein a communicating passage is formed between said pair of pressed plates for directing refrigerant from said first tank portion into said second tank portion.

7. A laminated type heat exchanger according to claim 1, wherein said laminated heat exchanger is employed as a refrigerant evaporator for a refrigerating cycle.

8. A laminated heat exchanger according to claim 1, wherein said first tank portion is located between said second tank portion and said third tank portion.

9. A laminated heat exchanger according to claim 1, further comprising:

a partition plate for partitioning said second tank portion and said third tank portion alternately.

10. A laminated heat exchanger according to claim 1, wherein refrigerant flows into said second tank portion without passing through said first tank portion.

* * * * *